United States Patent [19]

Eickmann

[11] 4,184,820

[45] Jan. 22, 1980

[54] INTERNAL GEAR DEVICE WITH BALANCING RECESSES IN THE INSERT MEMBER

[76] Inventor: Karl Eickmann, 2420 Isshiki, Hayama-machi, Kanagawa-ken, Japan, 240-01

[21] Appl. No.: 878,349

[22] Filed: Feb. 16, 1978

[51] Int. Cl.[2] ..... F01C 1/10; F01C 19/00; F01C 21/00; F03C 3/00

[52] U.S. Cl. ..... 418/71; 418/126; 418/170

[58] Field of Search ..... 418/71, 126, 169, 170

[56] References Cited

U.S. PATENT DOCUMENTS

| | | | |
|---|---|---|---|
| Re. 27,228 | 11/1971 | Brundage | 418/71 |
| 1,604,802 | 10/1926 | Brenzinger | 418/170 |
| 1,970,146 | 8/1934 | Hill | 418/71 |
| 2,544,144 | 3/1951 | Ellis | 418/170 |
| 3,592,572 | 7/1971 | Schnell | 418/169 |
| 3,730,656 | 5/1973 | Lambeth | 418/170 |

FOREIGN PATENT DOCUMENTS

| | | | |
|---|---|---|---|
| 2533646 | 2/1977 | Fed. Rep. of Germany | 418/126 |

*Primary Examiner*—John J. Vrablik

[57] ABSTRACT

In an internal gear pump or motor the insert control member between the inner and the outer gear is provided with balancing pockets, which receive fluid under pressure to counter-balance the pressure forces exerted onto the inner and outer gear of the device. Thereby it is obtained, that the radial forces of fluid onto the inner and outer gear are balancing each other by diametrically located oppositional directed fields of force of pressure in fluid. The inner and outer rotors such float freely between radial forces of fluid. Radial rest loads are prevented and the life of the rotors is extended. There may be a single insert or a plurality of inserts and there may be one or a plurality of suction chambers in the device. Additional outer guide means or pressure fields of fluid under pressure may be provided. The loading of the balancing pockets with pressure fluid may be done through respective passages from areas under pressure to said balancing pockets.

2 Claims, 3 Drawing Figures

Fig. 1
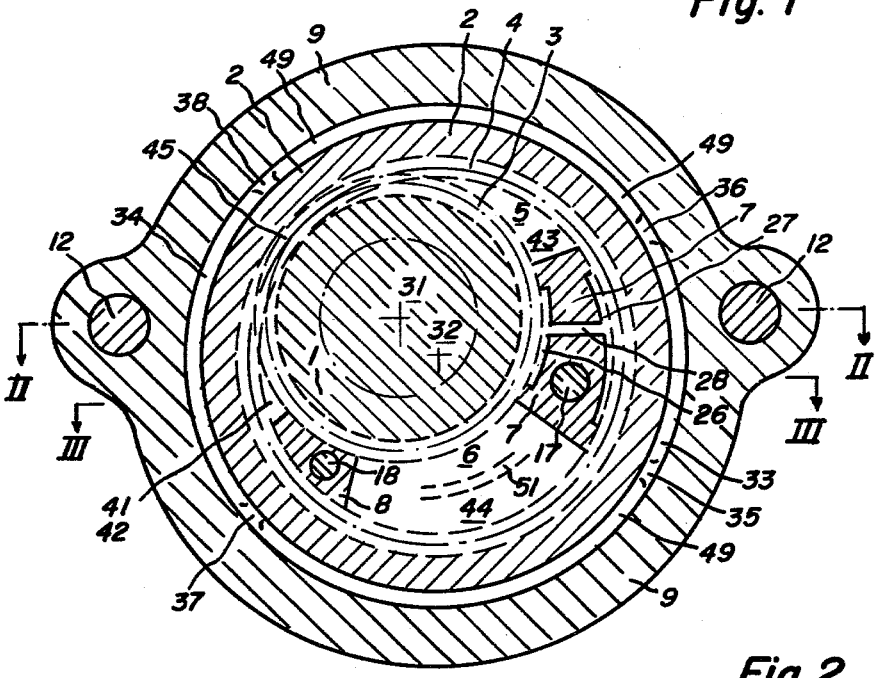
Fig. 2
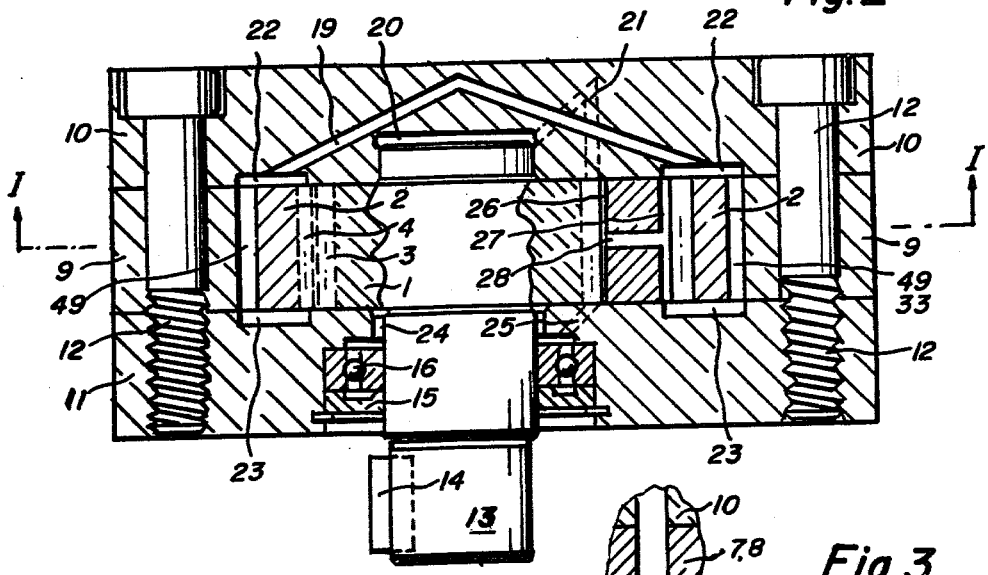
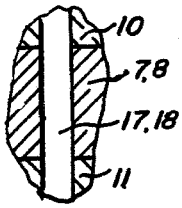
Fig. 3

INTERNAL GEAR DEVICE WITH BALANCING RECESSES IN THE INSERT MEMBER

BACKGROUND OF THE INVENTION

This is a continuation in part patent application of my co-pending patent application Ser. No. 859,789 of Dec. 8th, 1977. In said parental application a radial pressure balance of the inner and outer rotor of a gear pump or motor is disclosed. The means to provide such pressure balance consisted however in the application of radially moveable or deflectable seal means around the respective pressure balancing pockets in the insert or control member between the inner and outer gear.

It has now been found, that the desired effect can also be obtained by a more simple provision. This simple provision of the invention is, to provide a fitting insert between the inner and outer gear and the povision of balancing recesses or fluid pressure pockets in said insert. Thereby it is obtained, that the gear float between radially directed oppositionally directed forces of fluid diametrically of the rotors. This floating, which is obtained by this invention, prevents wear of the rotors. When there is no wear any more on the rotors, then they do not alterate any more. They remain closely fitting for a long useful life. Consequentely, due to this invention, the seal means of the parental application can be spared for a number of applications and pressure ranges or areas of revolutions per time. Thus, the machining of the device is now more simple and due to the invention, the device consists of only a few and non-deformable parts. Bearings can be spared or narrowed in size and costs. Further means and objects of the invenion will become appearing from the following:

The first object of the invention is, to provide a simple and inexpensive internal gear device like a pump or motor.

The second object of the invention is, to provide a fitting insert between the internal gear and the other gear and to provide in both radial outer faces of said insert fluid pressure pocket balancing recesses.

The third object of the invention is, to provide a plurality of inserts between the inner and outer gear.

The fourth object of the invention is, to provide a plurality of suction spaces in the internal gear pump or a plurality of exit spaces in the internal gear motor.

The fifth object of the invention is, to provide passage means from a chamber under high pressure in the device to the fluid-pressure balancing pocket(s).

The sixth object of the invention is to provide the passage means of the fifth object through a cover of the device.

The seventh object of the invention is to provide a free space around the outer rotor of the device.

The eighth object of the invention is to provide guide potions for the outer rotor between the housing and said outer rotor.

The ninth object of the invention is to provide fluid pressure balancing spaces outside of the outer rotor for prevention of radial deformation of thin outer rotors.

The objects of the invention may be applied either single or in combination, depending on design considerations or on manufacturing and cost-calculations.

By the objects and aims of the invention a most simple and reliable gear pump or motor of the internal gear type is obtained with a long useful life and with high efficiency at certain pressure and speed-ranges.

BRIEF DESCRIPTION OF THE DRAWING

FIG. 1 is a cross-sectional view through the middle of the gears, inserts and housing of the device of the invention; It corresponds to I—I of FIG. 2.

FIG. 2 is a cross-sectional view through FIG. 1 along the line II—II and thereby a longitudinal sectional view through the device of the invention.

FIG. 3 is a cross-sectional view through FIG. 1 along the line III—III, whereby FIG. 3 contains only a portion of the section, namely that portion which demonostrates the application of the holding means of the inserts of the invention.

DESCRIPTION OF THE PREFERRED EMBODIMENT

Housing 9 is provided with covers 10 and 11. Said covers may be partially integral with the housing. The inner rotor 1 is provided in said housing and extends through one of said covers. Bearing means 16 and seal means 15 to seal the shaft 13 of the inner rotor 1 may also be provided. Shaft 13 may carry a key means 14. The end of the shaft may extend endwards from the inner rotor and be borne in the other of said covers 10 or 11. The housing 9 and covers 10 and 11 may be bolted or fastened together by fastening means, holding means or bolts 12. The rotor 1 is revolvably borne in said housing and covers. The inner rotor 1 has outer teeth 3 which cam in the inner teeth of the outer rotor 2. The outer rotor 2 surrounds the inner rotor 1 but the inner diameter of the outer rotor 2 is bigger than the outer diameter of the inner rotor 1. Thereby a space is formed between the inner and outer rotors 1 and 2. The rotors are borne axially between innermost faces of the cover portions 10 and 11. They are also sealed by them. In the said space between the inner rotor 1 and the outer rotor 2 is at least one insert provided, which may also be called the control-member or control-insert. In the FIG. 1 two such control inserts are demonostrated. Control insert 8 is held by pin means 18 or another holding provison betwwen the rotors and the end-covers and it is closely fitting along the inner diameter of the outer rotor and the outer diameter of the inner rotor. Thereby it seals the high-pressure or delivery space of the pump, namely space 41 from the low pressure or pump's suction space. The gear teeth of the inner rotor 1 engage the spaces between the gear teeth of the outer rotor 2 and thereby a seal between the inner and outer teeth 3 and 4 of the inner rotor and outer rotor 1 and 2 is obtained in the area 45. When the device is a pump, than a delivery passage extends from delivery space 41 to the outside of the housing or cover. Said delivery passage is an entrance passage, when the device is a fluid motor. Further, when the device is a pump, an entrance or suction passage extends from the outside of the housing or of a cover to the entrance space 6 or 5 or 6 and 5 and said entrace passage is an exit passage, when the device is a fluid motor. The passages are not specifically demonstrated in the FIGS., because they may extend in axial direction through cover 10 and are then not specifically visible in FIG. 1, because they are in FIG. 1 in such case equal to the respective delivery or suction spaces. The referentials 42, 43 and 44 are shown in the FIG. 1 to demonstrate said entrance or exit passages. The centre line of the inner rotor 1 is shown in FIG. 1 by referential 31 and the centre line of the outer rotor 2 is shown in said FIG. by referential 32. The inserts 8 or 7 may be extended into respective holding spaces in the covers 10 and 11 and be borne therein or they may be fastened by pin(s) 17 or 18 as shown in FIG. 3 relatively to the covers 10 and 11. Such fastening is generally known in the art. The general arrangement of an internal gear pump or motor basically as described heretorfoe is also known in the art. What is considered or assumed to be novel is the following:

The control—or balancing insert 7 which may be integral with the control insert 8 or which may be as shown in FIG. 1 a separated insert, is substantially located diametrically of the high-pressure space 41 relatively of the rotors 1 and 2. It may be fastened by a separated pin 17 when it is not integral with control insert 8. In case of a separated insert 7 the latter is merely a fluid pressure balancing insert, but not a flow-control-insert. It contains the pressure balancing recesses or fluid pockets 26 and 27. Pocket 26 is radially inward directed and the fluid in it acts against the outer face portions of the inner rotor.

Pocket 27 is radially outward directed and the fluid in it acts radially outward against the inner face portions of the outer rotor 2. The cross-sectional areas through the said pockets 26 and 27 parallel to the said inner or outer face portions may be substantially equal and radially of each other. Thereby the insert floats between said fluid pressure pockets 26 and 27 and is thus free of remaining radial load. Pockets 26 and 27 may be communicated together by passage 28. The said cross-sectional areas through said fluid pressure pockets 26 and 27 are further substantially equal in size to the respective cross-sectional areas through the high pressure space 41, but they are relatively to said rotors 1 and 2 diametrically located. Thereby the pressure of fluid acting onto the inner and outer rotor 1 and 2 from the high pressure space 41 is substantially equal, but diametrically located and oppositionally directed to the said pressure of fluid acting out of balancing pockets 26 and 27 onto the said rotors 1 and 2. From high-pressure space 41 a passage means 19 may extend for example through cover 10 into balancing pockets 26 and 27 and fill them with fluid under equal high pressure. Thus, the rotors 1 and 2 as well as the insert portion 7 float radially under forces of fluid under pressure, substantially so, thatn no or only a small radial load remains on the rotors or insert(s). Thereby a frictionless move, namely rotation, of the rotors 1 and 2 is achieved and the pump thereby obtains a long life of good efficiency and the same is the case when the device acts as a fuid motor. For very high pressure the seal means of the parental application may be added to obtain a good tightness and thereby a good volumetric efficiency.

Endwards of the inner rotor 1 spaces which fill with fluid in operation may occure. They are to be disloaded by passages, for example passage 25 from space 24 and passage (dotted line) 21 from space 20 to low pressure spaces in the device. Recesses 22,23 may be provided in the cover(s) 10 and/or 11 to communicate the outer and inner balancing pockets 26 and 27 or to communicate insides and outsides of the outer rotor 2.

The outer rotor 2 may be provided in a space in the housing 9. Said space in the housing 9 has referential 49 and may be of such radial extension, that the outer face of the outer rotor 2 does not touch the inner face of the housing 9. Thereby a frictionless rotation of the outer face of rotor 2 in the housing 9 would be assured. If the guiding of the outer rotor 2 requires it, the housing 9 may be provided with guide portions 38 for the guiding of the position and/or rotation of the outer rotor 2. Said guide portions 38 may also serve as sealing means for the provision of pressure balancing chambers outside of the outer rotor 2. In such case the seal and guide portions 36,35,38,37 may be provided in the housing 9 for guiding and sealing the outer face of outer rotor 2 and thereby to form the radially diametrically located and opposed fluid pressure balancing recesses or spaces 33 and 34. These spaces may be substantially of the same cross-sectional area as the high pressure area 41 and as the fluid pressure balancing pockets 26 and 27 and be located radially outside of them.

The fluid pressure balancing insert 7 may either be integral with the seal and control insert 8 or be a separated insert. If it is integral with the said seal- and control-insert 8 it may be integral with it by a narrow connection portion 51 shown by dotted lines in FIG. 1. When the said narrow portion 51 is provided, then there are radially of it two suction chambers 6 and 44 which serve as secondary suction chambers or low pressure chambers after the first suction or low pressure chamber 5. The provision of such second suction chambers assures a full filling of the pump even when the pump is self-suctioning. When both insert portions 7 and 8 are separated from each other and are separated parts, a second low-pressure or suction-chamber 6 appears between them. The provision of such second suction chamber 6 again has the purpose of assuring a good filling of all spaces between the gears of the inner and outer rotors 1 and 2.

The passage means described in the preferred embodiment may also be provided at suitable other places with respective configurations. The recesses 22,23 may be set or eliminated according to actual design requirements.

Modifications are possible without leaving the scope of this invention and the seal means of the parental application may wholly or in part be added to the present invention, if so required for extremely high pressures or for extremely high volumetric efficiencies. The extensions of seal faces or seal portions depends on the actual design and requirements.

What is claimed is:

1. An internal gear type fluid flow handling device, such as a pump or motor, with a commonly known structure of a housing means, cover means, entrance passage(s), exit passage(s), at least one rotary inner gear with outer gear teeth with outer faces on said teeth forming an interrupted outer diameter of said inner gear and at least one rotary outer gear with inner gear teeth with inner faces on said teeth forming an interrupted inner diameter of said outer gear, said outer gear being provided radially of said inner gear, said inner diameter of said outer gear being bigger than said outer diameter of said inner gear, said outer gear being eccentrically mounted with respect to said inner gear, mashing with said inner gear and thereby forming a fluid containing space between said gears and said covers, at least one partially crescent shaped insert between said gears and said covers for sealing at least one portion of said space from an other portion of said space, sealing provisions for the ends of said gears, for portions of said inner diameter and said outer diameters of said gears and for at least one portion of said space; a high-pressure area in said space; and in addition to said known structure a novel improvement, comprising, at least one fluid pressure forces balancing insert-portion on said insert between said gears within said space and located substantially diametrically of said high pressure area of said device; while said balancing insert-portion is provided with inner-and outer- fluid pressure balancing recesses, inner and outer seal faces on the ends of said recesses, at least one passage means extending from said high pressure area to at least one of said recesses, fluid communication means between said recesses, wherein said recesses are facing said teeth of said gears, respectively, said outer seal faces are facing said inner diameter of said outer gear and said inner seal faces are facing said outer diameter of said inner gear.

2. A device of claim 1, wherein said space forms two high pressure areas and two low pressure areas, wherein said insert forms a leading portion and a trailing portion relatively to the rotary movement of said rotary gears, wherein one of said high pressure areas is located between said trailing portion, said covers and said gears, wherein one low pressure area is located between said leading portion, said covers and said gears, wherein an other high pressure area of said two high pressure areas is located in said leading portion and constituted by said recesses and said communication therebetween;

wherein an other low pressure area of said two low pressure areas is located between said leading portion and said traling portion of said insert and between said gears and said covers, while said high pressure areas are communicated with each other and said low pressure areas are also communicated with each other and wherein said other high pressure area and said low pressure areas are sealed from each other by said inner and outer seal faces, while said one high pressure area is sealed relatively to said other low pressure area by said trailing portion of said insert.

* * * * *